US011154977B2

(12) United States Patent
Jackson-Coty

(10) Patent No.: US 11,154,977 B2
(45) Date of Patent: Oct. 26, 2021

(54) GRIP FOR A HANDHELD INSTRUMENT

(71) Applicant: Janet Mary Jackson-Coty, Haddonfield, NJ (US)

(72) Inventor: Janet Mary Jackson-Coty, Haddonfield, NJ (US)

( * ) Notice: Subject to any disclaimer, the term of this patent is extended or adjusted under 35 U.S.C. 154(b) by 0 days.

(21) Appl. No.: 16/529,668

(22) Filed: Aug. 1, 2019

(65) Prior Publication Data

US 2021/0031355 A1 Feb. 4, 2021

(51) Int. Cl.

*B25G 1/10* (2006.01)
*A46B 17/02* (2006.01)
*A46B 5/02* (2006.01)

(52) U.S. Cl.

CPC ..... *B25G 1/102* (2013.01); *A46B 17/02* (2013.01); *A46B 5/02* (2013.01)

(58) Field of Classification Search

CPC ..... B25G 1/102; A46B 17/00; A46B 17/02; A46B 5/02; A46B 5/021; A46B 5/026; A46B 17/06; A46B 2200/20; A46B 2200/202; A46B 2200/205

USPC ..... 16/430; 15/143.1, 246

See application file for complete search history.

(56) References Cited

U.S. PATENT DOCUMENTS 4,386,448 A * 6/1983 Kohn ..... A46B 5/02 16/441
5,926,912 A * 7/1999 Claphan ..... A41D 19/01547 16/110.1
10,449,663 B2 * 10/2019 Martin ..... A46B 5/021
2003/0005533 A1 * 1/2003 Woodnorth ..... B05C 17/0205 15/143.1
2011/0083690 A1 * 4/2011 Cardenas ..... A45D 44/005 132/120
2012/0054986 A1 * 3/2012 Wood ..... B25G 1/102 16/430
2012/0167348 A1 * 7/2012 Adams ..... B25G 1/102 16/426
2014/0260838 A1 * 9/2014 Phui ..... B25G 3/12 81/489
2015/0310763 A1 * 10/2015 Miller ..... G16H 20/30 434/260
2018/0168379 A1 * 6/2018 Delaforce ..... A47G 21/08

(Continued)

FOREIGN PATENT DOCUMENTS

GB 422700 A * 1/1935 ..... A46B 15/00

OTHER PUBLICATIONS https://www.wetcanvas.com/forums/topic/wip-tennis-ball-adapter-painting/ "WIP: Tennis Ball Adapter Painting", by user judyfilarecki, posted Oct. 12, 2009. (Year: 2009).*

*Primary Examiner* — Emily M Morgan

(57) ABSTRACT

A system, method, and apparatus may be provided for gripping a handheld instrument. A spherical body may be configured to support at least a portion of the handheld instrument. A working portion of the handheld instrument may be oriented below a body of the gripping device. A top opening may be provided at a top of the gripping device, wherein the top opening may be configured to receive a portion of the handheld instrument. A bottom opening at the bottom of the gripping device may be provided, wherein the bottom opening may be configured to receive a portion of the handheld instrument. A convex surface may receive a palmar surface of a user's fingers, thumb, and/or hand.

6 Claims, 7 Drawing Sheets

(56) References Cited

U.S. PATENT DOCUMENTS

| | | | | |
|---|---|---|---|---|
| 2020/0011477 | A1* | 1/2020 | Wartersian | A47G 21/14 |
| 2020/0352318 | A1* | 11/2020 | Tucker | A46B 17/02 |

* cited by examiner

GRIP FOR A HANDHELD INSTRUMENT

CROSS-REFERENCE TO RELATED PATENT APPLICATIONS

This application claims the benefit of U.S. Provisional Application No. 62/715,773, filed on Aug. 7, 2018, which is incorporated by reference in its entirety.

BACKGROUND

Neutral alignment of the joints of the fingers, thumb and hand is represented by the following ranges of joint positions: Forty five degrees of flexion at the metacarpal phalangeal joints, 30-45 degrees of flexion at the proximal inter phalangeal joints, 10-20 degrees of flexion at the distal inter phalangeal joints of the fingers, and partial abduction and opposition of the of the first carpal metacarpal joint, 10 degrees of flexion at the metacarpal phalangeal joint and 5 degrees of flexion at the inter phalangeal joint of the thumb. The intrinsic muscles are the smaller muscles located within the hand itself. The extrinsic muscle groups are the long flexors and extensors that move the fingers, thumb and hand. They are called extrinsic because their muscle bellies are located on the forearm.

This neutral alignment creates the optimal position for the balanced activation of the intrinsic muscles of the hand and extrinsic flexor muscles of the forearm that are recruited or activated when gripping and using a handheld instruments. This neutral positioning result in decreased stress and strain on the intrinsic muscles of the hand resulting in less fatigue and cramping of these muscles when using handheld instruments. Placing the center of mass of the handheld instrument close to the point of movement of the hand at the wrist joint also decreases the stress and fatigue on the intrinsic muscles of the hand and the extrinsic muscles of the forearm.

Several types of gripping devices for handheld instruments have been disclosed. These include modified handles that are integral to the handheld instrument and devices that attach to the handheld instrument or the handle of the handheld instrument. None of these devices, when used on the handheld instrument, positions the joints of the fingers of the hand in optimal alignment to decrease stress and strain to the intrinsic muscles of the hand and decrease the potential for fatigue and cramping of these muscles when using the handheld instrument. None of these devices, when being used on the handheld instrument, positions the center of mass of the handheld instrument close to the point of movement of the hand at the wrist joint which decreased the amount of torque created by the hand held instrument at point of movement of the hand around the user's wrist. Decreasing the torque created by the handheld instrument decreases the amount of work required of the intrinsic muscles of the hand and the extrinsic muscles of the forearm resulting in decreased fatigue of these muscles when gripping and using the handheld instrument.

BRIEF SUMMARY

The general purpose of the present invention that will be subsequently described in greater detail is to improve the manner in which a handheld instrument is gripped. Specifically, it is a device that, when used on the handheld instrument, positions the joints of the fingers of the hand in optimal alignment to decrease stress and strain to the intrinsic muscles of the hand and decrease the potential for fatigue and cramping of these muscles when using the handheld instrument. To attain this, the present invention comprises a substantially spherical body having a hole that is offset from the center of the spherical body toward the front of the body for receiving the handle of the handheld instrument and an exterior for receiving the users' thumb, fingers and palmar surface of the hand.

An objective of the present invention is to provide a grip that, when used on a handheld tool, positions the users' hands in neutral alignment to decrease the amount of work required by the muscles of the hand and forearm when using the handheld instrument.

Another objective of the present invention is to provide a grip that, when used on a hand held tool, places the hand held tool close to the axis of movement of the user's hand at the user's wrist joint to decrease the amount of torque produced by the hand held instrument, therefore, decreasing the amount of work that the users' muscles need to produce to use the hand held instrument.

Another objective of the present invention is to decrease the amount of stress and strain on the muscles of the hand and forearm when using a handheld instrument by positioning the user's hand in neutral alignment and placing the hand held instrument close to the axis of movement of the user's hand at the user's wrist.

The present invention is used for aiding in the gripping of a handheld instrument that is comprised of a somewhat long cylindrical handle and a flat portion that is an extension of or attached to the cylindrical handle. The present invention includes a substantially spherical body having a hole for receiving the handle of the handheld instrument. The present invention includes exterior gripping surfaces for receiving the palmar surface of the user's thumb, a second gripping surface for receiving the palmar surface of the fingers of the user's hand and a third surface for receiving the palm of the user's hand.

A system may be provided for gripping a handheld instrument. A spherical body may be configured to support at least a portion of the handheld instrument. A working portion of the handheld instrument may be oriented below a body of the gripping device. A top opening may be provided at a top of the gripping device, wherein the top opening may be configured to receive a portion of the handheld instrument. A bottom opening at the bottom of the gripping device may be provided, wherein the bottom opening may be configured to receive a portion of the handheld instrument. A convex surface may receive a palmar surface of a user's fingers, thumb, and/or hand.

A system may be provided for gripping a hand held instrument that may be comprised of a material that will compress or deform to conform to the user's hand and to the hand held instrument.

A system may be provided for gripping a hand held instrument that may have a surface that is textured and/or non-skid on the exterior concave surface or within the hole, grove, opening that receives the hand held instrument.

DESCRIPTION

Figure 1:
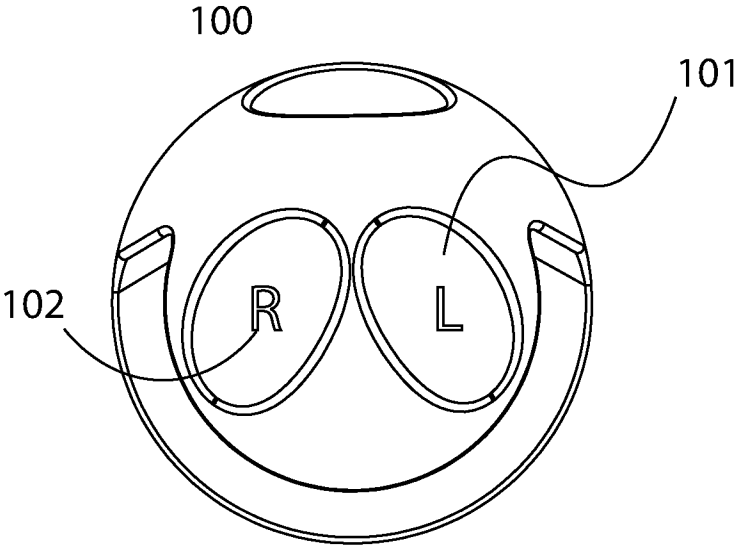
FIG. 1 shows the front view of the device 100.

The invention relates to a grip for a handheld instrument for aiding persons in holding or gripping a handheld instrument.

The handheld instrument grip is positioned on a handheld instrument for use and provides a gripping surface for the user's hand which positions the fingers, the thumb and the hand in neutral alignment. This alignment allows for activation of both the intrinsic muscles of the hand and the extrinsic muscles of the forearm to reduce discomfort and cramping of the smaller intrinsic muscles of the hand while using the handheld instrument. This device, when being used with a handheld instrument, positions the center of mass of the handheld instrument close to the point of movement of the hand at the wrist joint. This decreases the amount of torque around the point of movement of the hand at the wrist resulting in a decrease in the amount of work that needs to be produced by the intrinsic and extrinsic muscles of the hand and wrist resulting in decreased stress and fatigue to the intrinsic muscles of the hand and the extrinsic muscles of the forearm.

This device is used for aiding in the gripping of a handheld instrument that is comprised of a somewhat long handle (e.g., cylindrical handle) and/or a portion (e.g., flat portion) that may be an extension of, or attached to, the cylindrical handle. The device may include a substantially spherical body having a hole that is offset from the center of the spherical body toward the front of the body for receiving the handle of the handheld instrument and an exterior for receiving the user's thumb, fingers, and/or palmar surface of the hand. The offset hole may run through the entire body of the device (e.g., from top to bottom). The hole may widen to the sides of the device at the bottom of the device, for example, to transform to a groove (e.g., a rectangular, square, oval, etc., groove). The groove may be wider on one side than another side. For example, the groove may be wider from side to side than from front to back. The groove may be offset from the center of the spherical body toward the front of the device in alignment with the hole.

The hole at the top of the device may receive the handle of the handheld instrument. The groove (e.g., rectangular groove) at the bottom of the device may receive a portion (e.g., the flat portion) of the handheld instrument. The handle (e.g., cylindrical handle) of the handheld instrument may be inserted into the device, for example, from the bottom through the rectangular groove and through the device to exit at the hole at the top of the device. The handle of the handheld instrument may extend beyond the upper surface of the device as it passes through the hole at the top of the device. The flat portion of the handheld instrument may fit (e.g., snuggly fit) into the groove at the bottom of the device. The flat portion of the handheld instrument may extend beyond the groove (e.g., rectangular groove) at the bottom of the device, for example, so that the working portion of the handheld instrument may extend below the device.

The position of the device when placed on the handheld instrument may be at the relative center of the handheld device, for example, where the user's thumb, fingers, and/or hand may be positioned if the user was using the handheld instrument without the gripping device. In other examples the position of the device when placed on the handheld instrument may be on one or more sides of the handheld device.

The substantially spherical body of the device may fill the space created by the user's thumb, fingers, and/or hand when positioned in neutral alignment with one or more of the following example alignments: thirty to fifty (e.g., forty five) degrees of flexion at the metacarpal phalangeal joints, fifteen to sixty (e.g., thirty to forty-five) degrees of flexion at the proximal inter phalangeal joints, five to thirty (e.g., ten to twenty) degrees of flexion at the distal inter phalangeal joints of the fingers, and partial abduction and opposition of the of the first carpal metacarpal joint, five to fifteen (e.g., ten) degrees of flexion at the metacarpal phalangeal joint, and/or five degrees of flexion at the inter phalangeal joint of the thumb.

The exterior may include a first gripping surface for receiving the palmar surface of the user's thumb, a second gripping surface for receiving the palmar surface of the fingers of the user's hand, and/or a third surface for receiving the palm of the user's hand. The first gripping surface may be on the front of the device and/or may have one or more concave depressions for receiving the palmar surface of the users thumb and/or may include surface indicia for providing a reference for the placement of the thumb of the user's hand. The surface indicia may include one letter or word to designate the placement of a right or left thumb. The character may be disposed at a level different than the level of the surfaces adjacent to the character.

The exterior surface may include a second gripping surface that may be on the back of the device, for example, for receiving the palmar surface of the user's one or more (e.g., four) fingers. The exterior surface may include a third gripping surface on the side of the device, for example, between surfaces one and two, that may be used for receiving the palm of the user's hand. A side may receive the palm of a right-handed user and another side may receive the palm of a left-handed user. The spherical shape of the exterior surfaces of the device may place the joints of the user's hands in the position of neutral alignment.

The exterior surface of the device (e.g., where the user's hand is in contact with the device) and/or the interior surface of the device (e.g., where the hand held instrument comes in contact with the device) may have a textured and/or a nod skid surface.

The device may be made of a material that compresses or conforms (e.g. closed cell foam, plastic silicon) to allow the device to conform to the shape of the hand held instrument and/or conform to the user's hand and to allow the hand held device to fit (e.g., snuggly fit) into the device.

FIG. 1 shows a front view of an example device, as described herein. The view includes the concave surfaces 101 which may receive the pad of the right or left thumb depending on the hand that the user prefers for gripping and using the handheld instrument. The concave surfaces may include surface indicia 102 for providing a reference for the placement of the thumb of the user's hand. Example surface indicia may include a letter such as "R" or "L," or a word such as "right" or "left" to designate the placement of a tight or left thumb. The character may be disposed at a level different than the level of the surfaces adjacent to the character.

Figure 2:
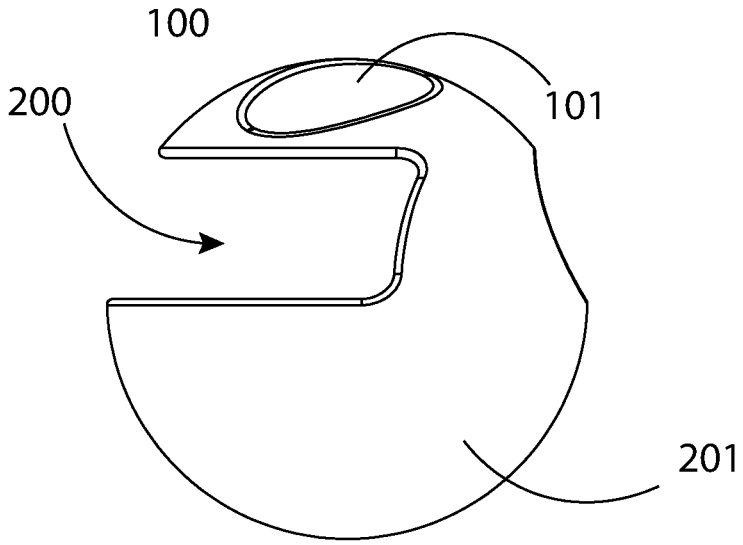
FIG. 2 shows the side view of the device 100.

FIG. 2 shows the side view of an example device, as described herein. The view includes the groove (e.g., rectangular groove, oval groove, etc.) 200 that may receive the flat surface of the handheld instrument and the curved surface 201 that may receive the four fingers of the user's hand. As described herein, the groove and/or curved surface may place the user's hand (e.g., fingers of the user's hand) in neutral finger alignment. FIG. 2 includes the curved surface 101 that receives the thumb of the user's hand and places the thumb in neutral thumb alignment.

Figure 3:
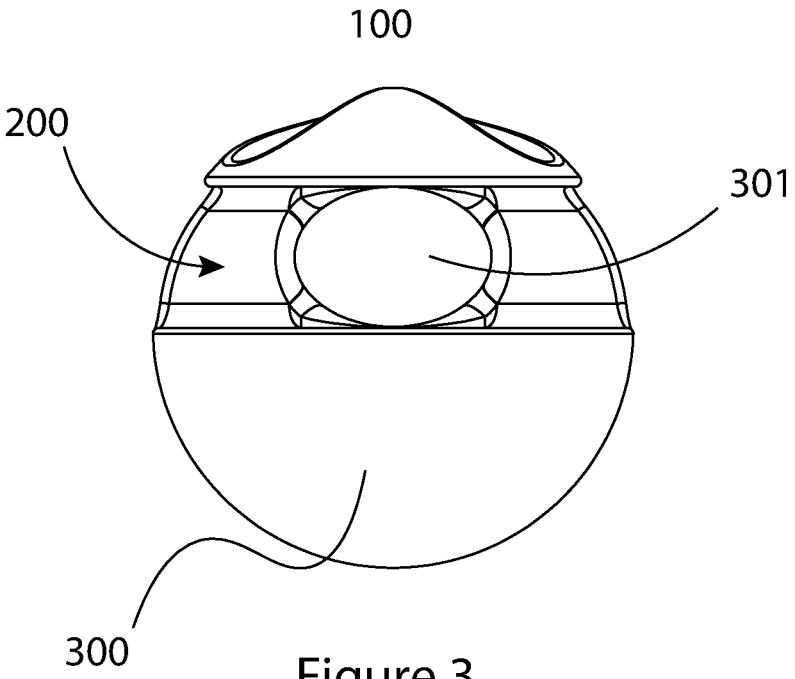
FIG. 3 shows the bottom of the device 100.

FIG. 3 shows the bottom of an example device, as described herein. The view includes the spherical body 300 of the device, rectangular groove 200 (that may be offset from the center of the spherical body of the device) for receiving the flat surface of the handheld instrument, and the bore hole 301. The bore hole 301 may be used to offset from the center of the spherical body of the device, for example, for receiving the handle of the handheld instrument.

Figure 4:
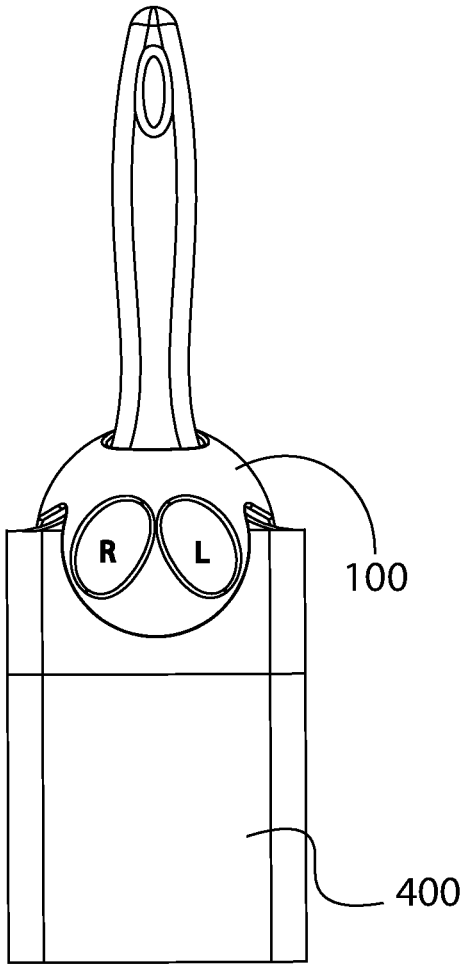
FIG. 4 shows the front view of the device 100 mounted onto a handheld instrument 400 in the form of a paintbrush.

FIG. 4 shows the front view of the example device mounted onto a handheld instrument 400. Although the handheld instrument is shown as a paintbrush in FIG. 400, it is understood that the handheld instrument may be any instrument that may be held by one or more hands. For example, the handheld instrument may be a hand tool, a sporting instrument, a writing tool, etc. The view includes an example orientation of the handheld instrument when the ergonomic gripping device 100 is attached.

Figure 5:
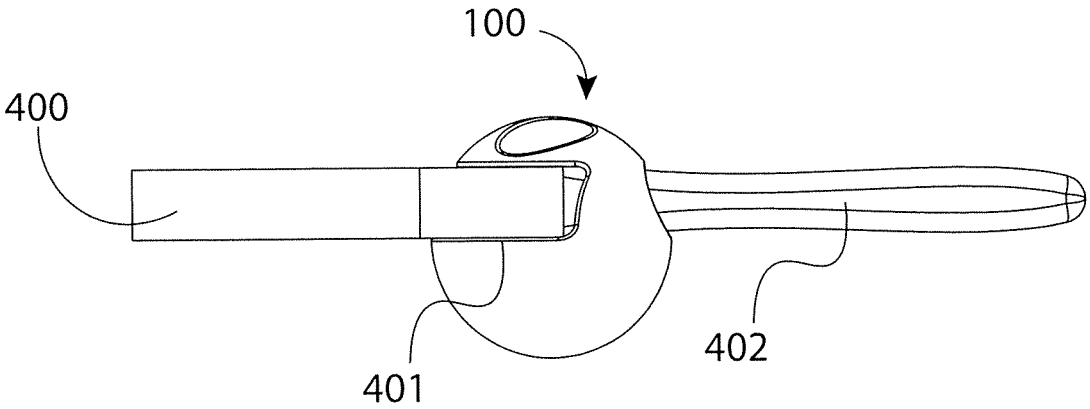
FIG. 5 shows the side view of the device 100 mounted onto a handheld instrument 400 in the form of a paintbrush.

FIG. 5 shows the side view of the device mounted onto a handheld instrument 400 in the form of a paintbrush, although the paintbrush is for illustration purposes only. FIG. 5 includes the flat surface 401 and the handle of the handheld instrument 402 as they are positioned in the device 100.

Figure 6:
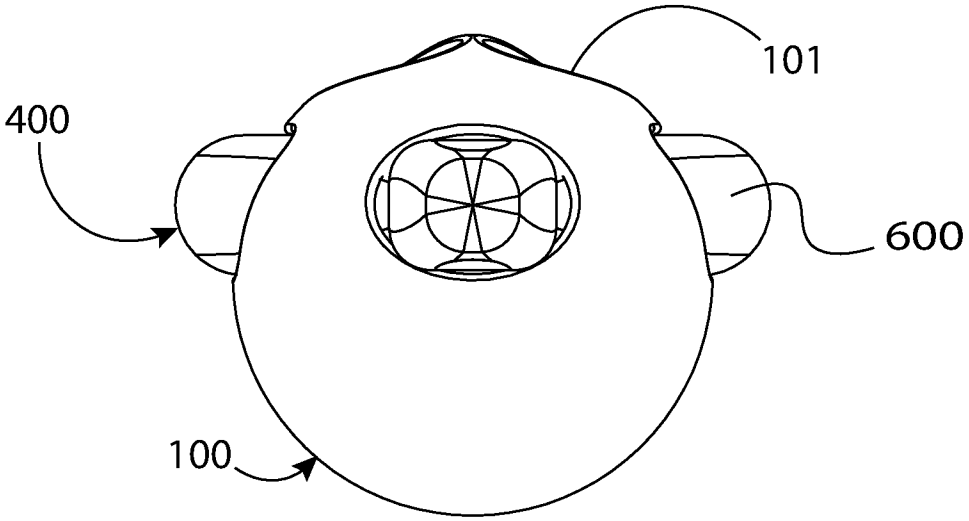
FIG. 6 shows the bottom of the device 100 mounted onto a handheld instrument 400 in the form of a paintbrush.

FIG. 6 shows the bottom of the device mounted onto a handheld instrument 400 in the form of a paintbrush, although the paintbrush is for illustration purposes only. The view includes the flat surfaces 600 of the handheld instrument as it is positioned in the rectangular grove 400 of the device. This view also includes the view of the curved surfaces 101 that receive the user's thumb and fingers.

Figure 7:
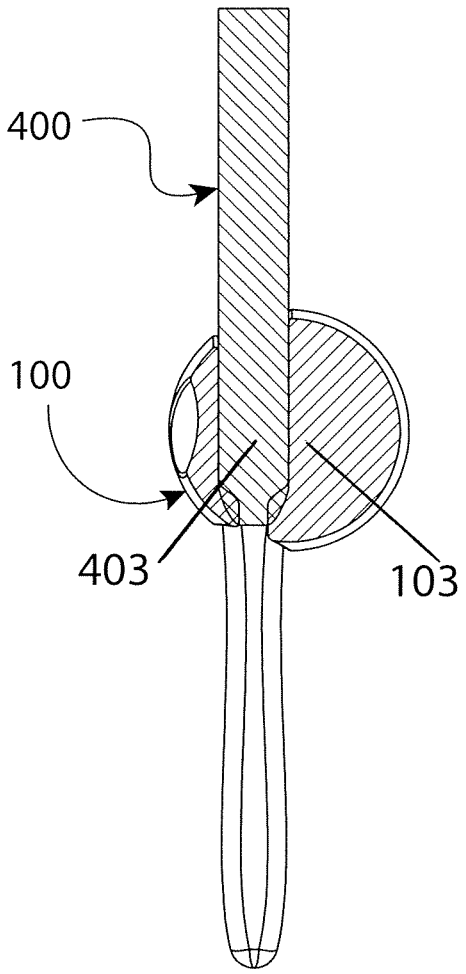
FIG. 7 shows the side view of a cross section of the device 100 mounted onto a handheld instrument 400 in the form of a paintbrush.

FIG. 7 shows the side view of a cross section of the device mounted onto a handheld instrument 400 in the form of a paintbrush. The view includes the center of mass of the paintbrush 403 and the center of the spherical body (device) 103.

What is claimed is:

1. A system comprising:

a paintbrush having an elongated handle having a free end, and a wider end opposite the free end, the wider end is generally flat, and a plurality of bristles attached to the wider end of the handle, and a spherical body having a center along an axis, a through hole parallel to and offset from the axis, a rectangular groove that extends into the spherical body in communication with the through hole; and the free end of the paintbrush is inserted through the through hole of the spherical body, such that the wider end of the paintbrush is inserted in the rectangular groove, and such that the free end extends from the spherical body.

2. The system of claim 1, wherein an exterior surface of the spherical body includes gripping surfaces for receiving a user's thumbs.

3. The system of claim 1, wherein the gripping surfaces comprise at least one concave depression and includes indicia.

4. The system of claim 1, the spherical body includes a convex surface capable of engaging a user's palm.

5. The system of claim 1, wherein the spherical body comprises a compressible material to allow the paintbrush to be inserted into the through hole.

6. The system of claim 1, wherein the bristles of the paintbrush are outside of the spherical body adjacent to the rectangular groove.

* * * * *